United States Patent [19]

Kissinger

[11] 4,182,413

[45] Jan. 8, 1980

[54] RADIAL FLOW HEAT EXCHANGER

[75] Inventor: John A. Kissinger, San Diego, Calif.

[73] Assignee: General Atomic Company, San Diego, Calif.

[21] Appl. No.: 753,898

[22] Filed: Dec. 23, 1976

[51] Int. Cl.[2] ..... F28D 7/10

[52] U.S. Cl. ..... 165/163; 176/87

[58] Field of Search ..... 165/162, 163; 122/32, 122/34; 176/59, 60, 64, 65, 84, 85, 72, 87

[56] References Cited

U.S. PATENT DOCUMENTS

| | | | |
|---|---|---|---|
| 2,715,019 | 8/1955 | Walter | 165/163 X |
| 2,980,404 | 4/1961 | Andersen et al. | 165/162 X |
| 3,882,933 | 5/1975 | Kube | 165/163 |
| 4,005,681 | 2/1977 | Lockett | 122/32 |

FOREIGN PATENT DOCUMENTS

| | | | |
|---|---|---|---|
| 1112996 | 8/1961 | Fed. Rep. of Germany | 165/163 |

*Primary Examiner*—Charles J. Myhre
*Assistant Examiner*—Theophil W. Streule, Jr.
*Attorney, Agent, or Firm*—Fitch, Even & Tabin

[57] ABSTRACT

An annular heat exchanger assembly is described which is particularly suited for structurally self supporting installation in a vapor generator associated with a nuclear reactor. The assembly includes parallel inlet and outlet header conduits interconnected by a multiplicity of helical tubes, adjacent portions of these tubes being tied together to increase structural integrity of the annular tube bundle formed by the helical tubes. Various baffles are employed as necessary to promote uniform flow of a heating fluid over the tubes in the tube bundle, preferably in a radial direction of flow.

13 Claims, 7 Drawing Figures

RADIAL FLOW HEAT EXCHANGER

BACKGROUND OF THE INVENTION

The present invention relates to an annular heat exchanger assembly. More particularly, the invention relates to such a heat exchanger assembly employable as a reheater section of a vapor generator suitable for use with a gas-cooled nuclear reactor in an electrical power generating facility.

A heat exchanger or vapor generator for use in a gas-cooled nuclear reactor provides an appropriate environment for the annular heat exchanger assembly of the present invention. Such an application particularly exemplifies problems which are overcome by the annular heat exchanger assembly of the invention. In this connection, gas-cooled nuclear reactors have been found to be a particularly efficient and economical means for producing electrical power from thermal energy developed within the reactor. Important operating conditions within such reactors include their operation at temperatures sufficiently high to directly produce steam at temperatures and pressures suitable for high efficiency operation of steam turbines.

In general, gas-cooled nuclear power plants circulate a primary coolant such as helium or carbon dioxide to withdraw thermal energy produced by the reactor; high temperatures are employed for greater efficiency. Steam for the operation of turbines is normally obtained by the transfer of heat from the primary coolant fluid to the secondary fluid of a watersteam system. This transfer of heat is commonly accomplished within a heat exchanger or vapor generator including various specialized sections permitting thermal energy withdrawn from the reactor to be utilized for the production of superheated steam.

When the heat exchanger or vapor generator is included within the same pressure vessel as the reactor itself, it is important that the size of the complete heat exchanger assembly be maintained at a minimum with the various heat exchanger sections being readily removable and replaceable through necessarily restricted openings in the containment vessel. It is also important, however, to maintain minimum gas flow resistance so that work expended in circulating the primary gas through the system may be minimized.

It is necessary to support the heat exchanger tubes at frequent intervals to protect them from flow-induced vibration earthquakes and their own dead weight loads. In the past, it had frequently been necessary to make these supports very large and strong because past heat exchanger design had limited the supports to a small number. As the tubes are internally cooled by the secondary fluid and the supports are maintained at a warmer temperature by the primary fluid, the tubes and the structures expand at different rates. In the prior art, complex arrangements of tubing have commonly been employed between heat exchanger sections to accommodate differential expansion. Because of other design problems, this tubing must usually be unheated which results in a decrease of efficiency for the heat exchanger.

Complying with design criteria of the type summarized above creates difficulties in the design of an effective heat exchanger or vapor generator for operation in applications such as gas-cooled nuclear reactors. Similar problems of complying with a limited space envelope and differential expansion while still providing an efficient unit are also encountered in other heat exchange applications where the heat exchanger assembly of the present invention may be employed to equal advantage.

Thus, there has been found to remain a need for an effective heat exchanger assembly having a compact annular configuration while providing effective heat exchange capabilities, maintaining minimum gas flow resistance and allowing for differential expansion without the use of unheated cross-over connections.

SUMMARY OF THE INVENTION

Accordingly, it is an object of the present invention to provide a compact self-supporting heat exchanger having a tube bundle assembly which is of annular configuration.

It is a further object of the invention to provide an annular heat exchanger tube bundle assembly including inlet and outlet header conduits arranged parallel with each other and with the axis of the tube bundle, the tube bundle being formed by a multiplicity of helical heat exchanger tubes forming the tube bundle, each tube including at least one full helical loop and a partial loop with its opposite ends being secured to the inlet and outlet header conduits, adjacent portions of the tubes being tied together to provide greater resistance to vibration and increased structural strength within the tube bundle.

It is an even further object of the invention to provide such a heat exchanger assembly wherein the inlet and outlet header conduits provide structural support for the annular tube bundle.

It is also a further object of the invention to provide such an annular tube bundle assembly having a portion of the helical tubes arranged in diametric opposition to the other helical tubes in order to provide even greater structural integrity for the annular tube bundle assembly.

It is also an object of the invention to provide such an annular heat exchanger tube bundle assembly including baffle means as necessary for producing more uniform flow of primary fluid past the helical tubes of the annular heat exchanger tube bundle.

It is an even more specific object of the invention to provide such an annular tube bundle assembly as a reheater section in a heat exchanger or vapor generator for a gas-cooled nuclear reactor or the like.

Additional objects and advantages of the present invention are made apparent in the following description having reference to the accompanying drawings.

DESCRIPTION OF THE PREFERRED EMBODIMENTS

Figure 1:
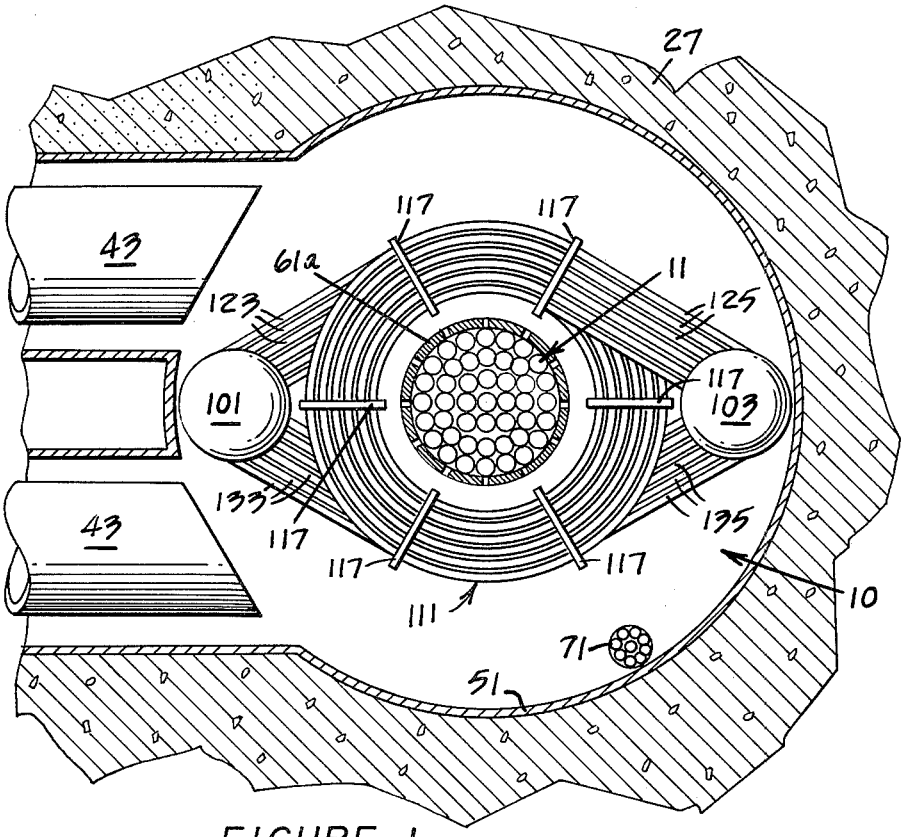
FIG. 1 is a plan view of an annular reheater section or tube bundle for a vapor generator.
Figure 2:
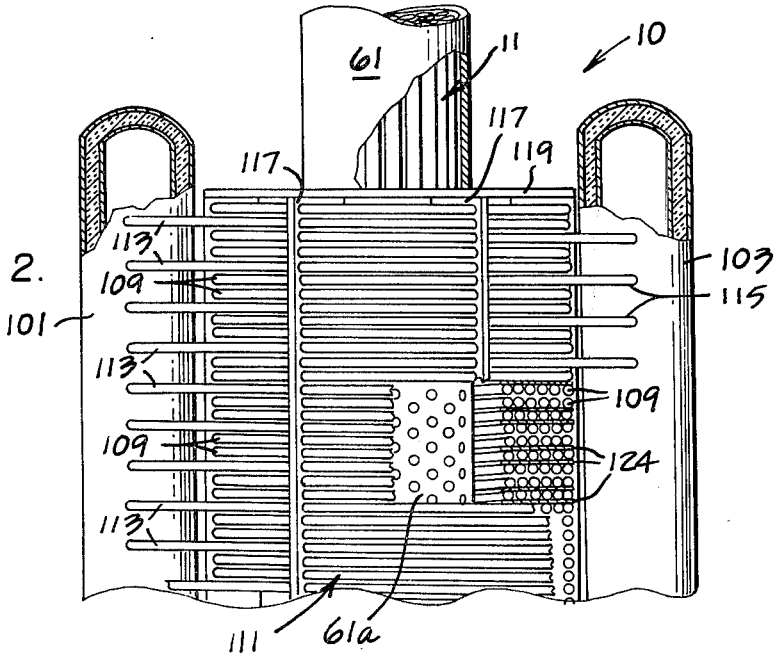
FIG. 2 is an enlarged, fragmentary side view of the reheater section of the vapor generator of FIG. 1.

Referring to the drawings, an annular heat exchanger tube bundle assembly 10 constructed according to the present invention is illustrated in FIGS. 1 and 2. The annular heat exchanger assembly 10 is also illustrated in FIG. 3 as a reheater portion of a heat exchanger or vapor generator in a gas-cooled nuclear reactor.

Figure 3:
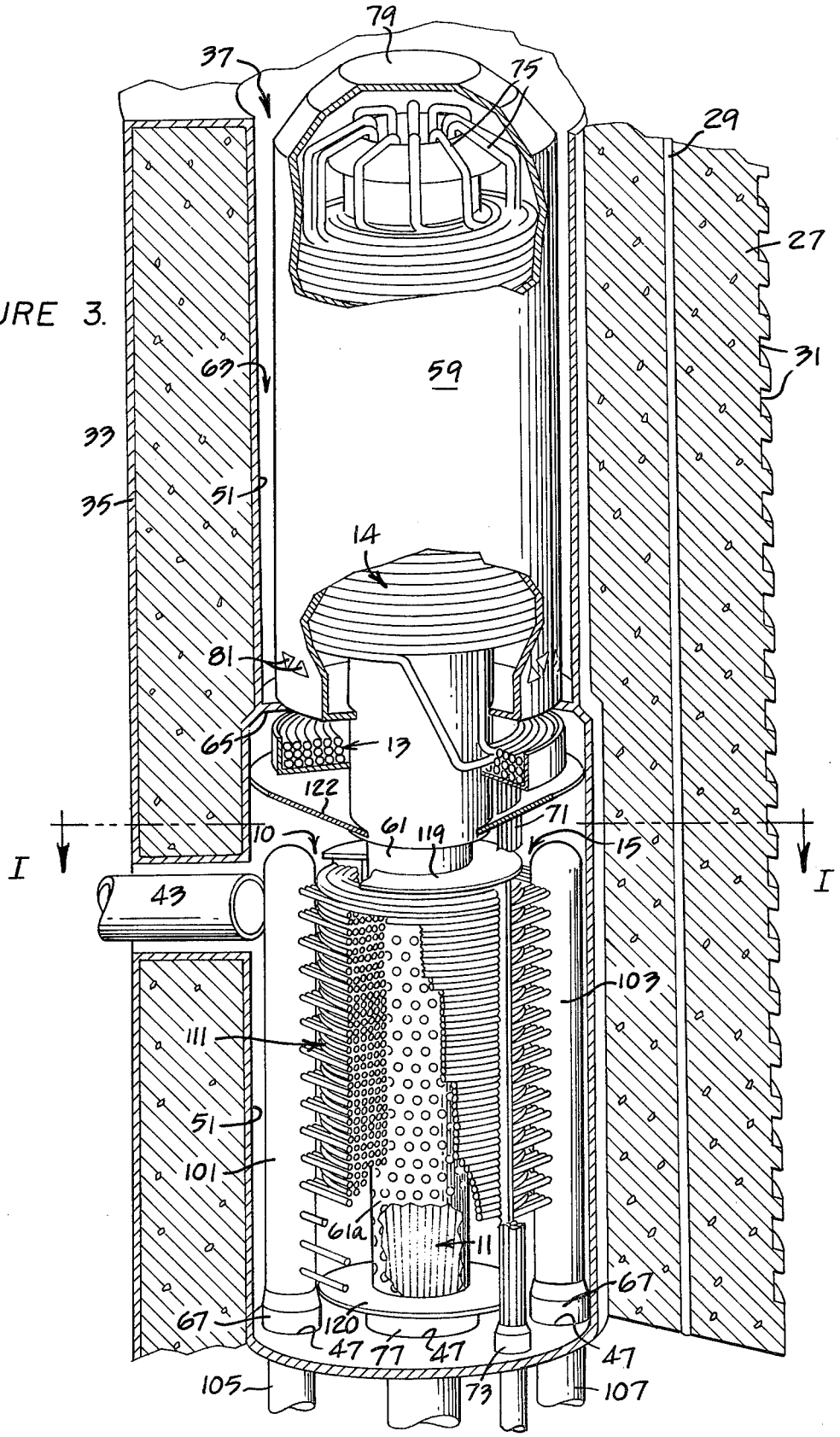
FIG. 3 is a perspective view, with parts broken away, of a heat exchanger or vapor generator as a portion of a gas cooled nuclear reactor including the annular tube bundle or reheater section of FIGS. 1 and 2.

The heat exchanger or vapor generator of FIG. 3 provides a preferred environment for the present invention and includes a high temperature section 11 having a plurality of elongated substantially straight tubes 12 forming an elongated tube bundle. An unheated feed water expansion tube section 13 is connected with a low temperature annular tube section 14 which coaxially surrounds the high temperature section 11. The main heat exchanger tube bundle assembly including the low temperature tube section 14 and the expansion tube section 13 is substantially shorter than the high temperature section 11 to form an annular space 15.

The annular heat exchanger tube bundle assembly 10 of the present invention is arranged within the annular space 15 to provide a reheater section for the vapor generator. The construction of the annular reheater tube bundle assembly 10 is described in greater detail below.

In operation, a primary heating fluid enters the vapor generator and passes through the reheater section 10, preferably in a radial direction, the primary heating fluid then flowing upwardly along the tubes of the high temperature section 11. At the top of the vapor generator, the primary heating fluid is directed outwardly and downwardly past the low temperature tube section 14 after which the heating fluid is directed upwardly for return to a heating source.

Only a portion of a gas-cooled nuclear reactor system incorporating the present invention is illustrated in FIG. 3. The reactor system includes a prestressed concrete pressure vessel 27 for containing the heat exchanger or vapor generator referred to above. Prestressing tendons 29 extend axially through the concrete of the cylindrical pressure vessel 27. Annular grooves 31 may be formed in the outer surface of the pressure vessel for accommodating circumferential prestressing bands which are not otherwise illustrated.

The pressure vessel 27 includes a main chamber 33 for containing a reactor core, not shown. The chamber 33 is provided with a liner 35 of suitable metal anchored to the concrete. As indicated above, the reactor core is adapted for gas cooling with provision being made for circulating a primary coolant gas, such as helium or carbon dioxide, over the reactor core which acts as a thermal source to heat the primary gas. The primary fluid is then circulated over the various heat exchanger sections of the vapor generator to produce steam for operating machinery such as turbines to generate electricity. The primary fluid is subsequently returned to the reactor core for reheating.

Within the illustrated reactor, the main chamber 33 is surrounded by a plurality of circumferentially spaced chambers 37, only one of which is illustrated in the drawings. Each of the chambers 37 is generally cylindrical in shape for containing a similar vapor generator and coolant circulating means as described herein.

Coolant gas is conducted from the main chamber 33 to the vapor generator through a pair of horizontal ducts 43. The coolant is returned to the chamber 33 for recirculation over the reactor core through a similar single horizontal duct partially illustrated in FIG. 3 at 45. Suitable enclosures (not shown) are provided at the upper ends of the chambers 33 and 37.

The chamber 37 is accessible from the lower end of the pressure vessel 27 through penetrations 47 which may be best seen in FIG. 3. Each of the penetrations 47 provides a connection for one of the sections within the vapor generator as is described in greater detail below.

The low temperature tube section 14 is contained within a cylindrical housing 59. As indicated above, the high temperature tube bundle 11 comprises tubes 12 extending downwardly through the annular tube bundle 10. A cylindrical housing 61 separates the low temperature tube section 14 from the high temperature tube bundle 11 and extends downwardly toward the annular space 15. A perforated portion **61*a* of the housing 61 extends downwardly between the high temperature tube bundle 11 and the annular tube bundle 10. Thus, the perforated housing acts as a baffle to improve the flow distribution of primary coolant gas through both the annular tube bundle 10 and the high temperature tube bundle 11**.

The housings 59 and 61 are supported by an annular mounting flange 65 which is secured to the chamber liner 51. The annular space 63 between the housing 59 and the surrounding chamber liner 51 is also blocked by the annular flange or ring 65 in order to isolate it from the high temperatures in the lower portion of the heat exchanger where the reheater 10 is located.

Feed water for the vapor generator is supplied through feed water inlet tubes 71 which pass upwardly through the space 15 and connect to the expansion tube section 13. A header 73 communicates feed water to the tubes 71. The low temperature tube section 14 is interconnected with the upper ends of the high temperature tube section 11 by means of cross-over tubes 75 which are flexible to accommodate differential thermal expansion and contraction of the tube bundles 11 and 14. Superheated steam exits the lower end of the high temperature tube section 11 through a superheated steam header 77.

Incoming hot gas from the reactor core enters the chamber 37 through the ducts 43. After circulating radially through the reheater section 10 as described in greater detail below, the gas flows upwardly along the high temperature tube section 11. An inverted cup-shaped gas flow-deflection plate 79 is arranged above the upper end of the housing 61 and secured to the housings 59. The primary gas passes through the space between the upper open end of the housing 61 and plates 79 and is then directed downwardly over the helical tubes in the tube bundle 14. After passing over the helical tubes in the tube bundle 14, the gas passes through ports 81 in the housing 59 and flows upwardly between the housing 59 and the wall or liner 51 of the chamber 37 to the upper duct 45 for recirculation to the reactor core.

The reheater section 10 provided by the present invention includes a vertical inlet header conduit 101 and a vertical outlet header conduit 103 which are supported by header bases 67, and are arranged in parallel relation and in diametric opposition within the annular space 15. Secondary fluid is introduced into the inlet header conduit 101 of the reheater section 10 through an inlet pipe 105 while heated fluid exits the reheater section 10 from the outlet header conduit 103 through an outlet pipe 107.

Referring particularly to the annular reheater 10 of FIGS. 1 and 2, a large number of helically shaped tubes 109 form an annular tube bundle 111 surrounding a portion of the high temperature tube section 11 for the vapor generator. Each of the tubes 109 is interconnected at its opposite ends 113 and 115 with the inlet and outlet header conduits 101 and 103 respectively. Each of the helical tubes 109 necessarily makes at least one full loop within the tube bundle 111 and a partial loop which permits interconnection with the spaced-apart inlet and outlet header conduits 101 and 103. Obviously, any number of full loops and a partial loop would permit connection between conduits 101 and 103. Adjacent portions of the tubes 109 within the annular tube bundle 111 are interconnected or held together by tie-bars 117 to provide greater vibration resistance and structural integrity within the annular tube bundle 111. The tie-bars 117 may also act as spacer plates supporting the helical tubes 109 in slightly spaced apart relation to maintain distribution of the primary heating fluid through the tube bundle 111.

It will be apparent that the inlet and outlet header conduits 101 and 103 could be arranged either radially inside or outside of the annular tube bundle 111. Preferably, the inlet and outlet header conduits 101 and 103 are arranged radially outside of the annular tube bundle 111 since other components for the vapor generator of FIG. 3 may then also be arranged in the circumferentially spaced apart relation outside of the annular tube bundle 111. For example, note the feed water tubes 71 in FIG. 3. In addition, with the header conduits being arranged outside of the annular tube bundle 111, the tube ends 113 and 115 may be formed as tangentially extending straight tubes for easier connection with the header conduits 101 and 103 (see FIG. 1). The tube ends are preferably secured to the header conduits, for example, by welding to provide structural support for the tubes 109 and the entire annular tube bundle 111.

Figure 4:
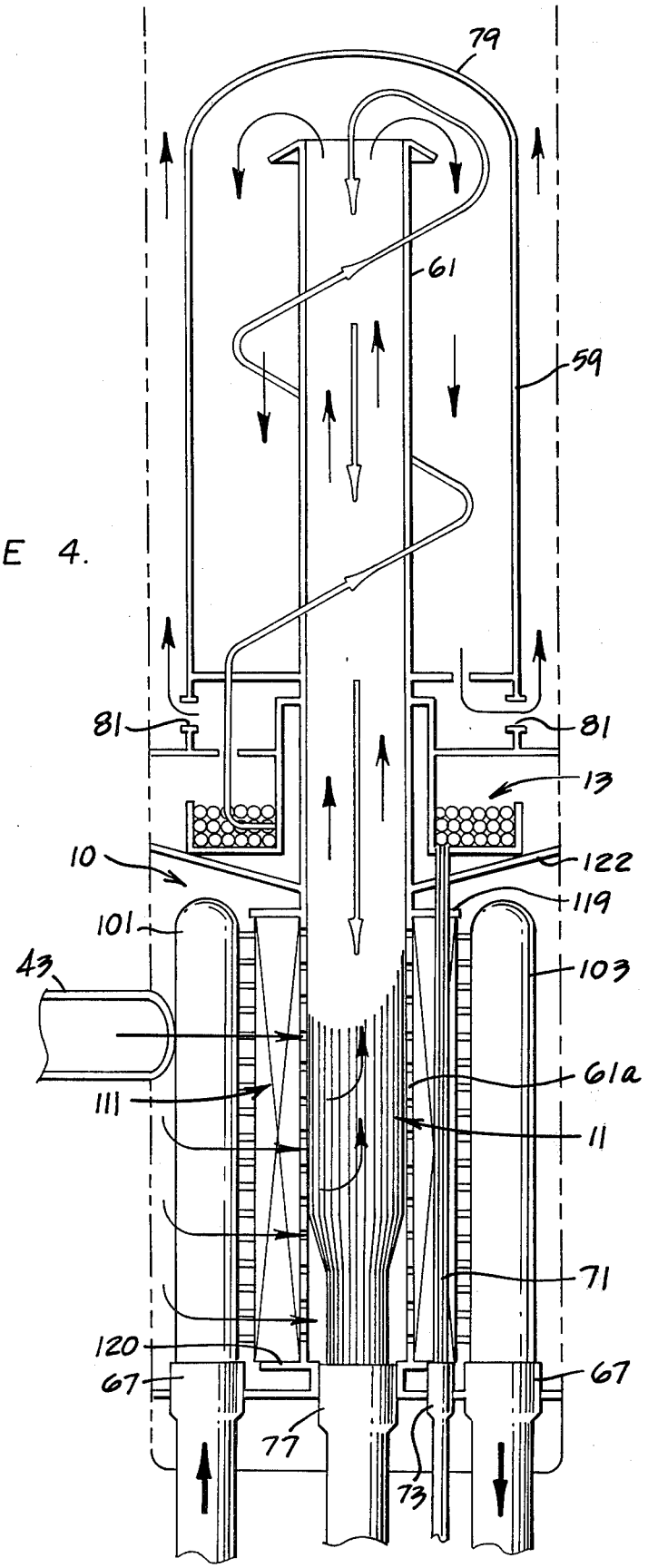
FIG. 4 is a schematic diagram illustrating the direction of primary and secondary fluid flow through the heat exchanger or vapor generator of FIG. 3 to emphasize the preferred radial flow of primary fluid through the annular heat exchanger assembly of the present invention.

As may be seen in FIG. 4, and as was described above, the primary fluid entering the chamber 37 through the conduits 43 is intended to pass radially through the reheater section 10. Accordingly, various deflector elements are employed to ensure relatively uniform radial flow of the primary fluid through the annular tube bundle 111. Referring particularly to FIGS. 1 and 2, annular deflector plates 119 and 120 are arranged above and below the reheater tube bundle 111 and extend inwardly to the housing 61. The plates 119 and 120 prevent primary fluid from entering directly into the space between the tube bundle 111 and housing 61 and thus provide for more uniform distribution of primary fluid flow through both the reheater tube bundle 111 and the high temperature tube bundle 11. Additional annular deflector plates 124 may be arranged in axially spaced apart relation within the tube bundle 111, if required, to assure uniform passage of the primary fluid through the tube bundle 111.

A dish-shaped deflector or baffle plate 122 directs primary fluid entering from the conduits 43 away from the expansion section 13.

Figure 5:
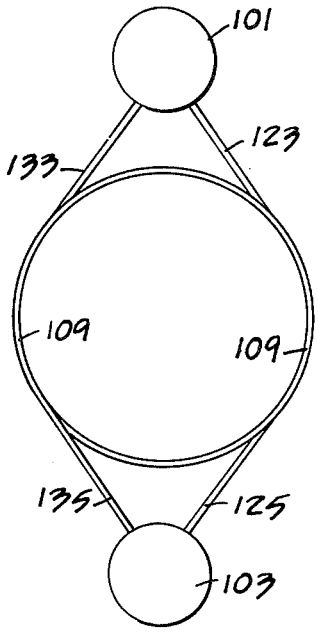
FIG. 5 is a schematic representation of basic components for the reheater assembly of FIGS. 1 and 2 when looking downwardly along the axis of the annular heat exchanger assembly.

Referring particularly to FIG. 3, it may be seen that certain of the tubes 109 within the annular tube bundle 111 are arranged in diametric opposition to each other. For example, certain of the tubes are interconnected with the inlet and outlet header conduits 101 and 103 by tube ends indicated at 123 and 125. The diametrically opposed tubes are interconnected with the inlet and outlet header conduits 101 and 103 by means of tube ends 133 and 135. This arrangement may be more clearly seen in the schematic representation of FIG. 5. Within that figure, diametrically opposed tubes 109 are illustrated in interconnection with the inlet and outlet header conduits 101 and 103. This arrangement, together with the tie-bars 117 as described above, provides even greater structural strength within the annular tube bundle 111. In addition, this arrangement provides a similar heat transfer configuration from both sides of the tube bundle.

Figure 6:
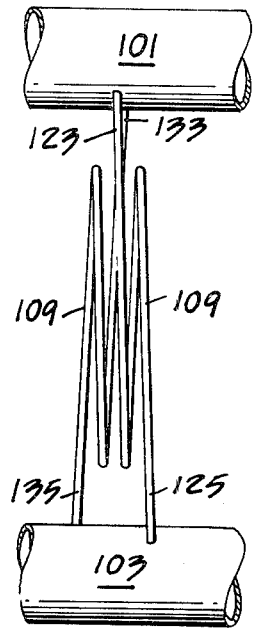
FIG. 6 is a similar schematic representation of the annular heat exchanger section when viewed from the side.

FIG. 6 illustrates each of the helical tubes making one and one-half loops between interconnections with the inlet and outlet header conduits 101 and 103.

Figure 7:
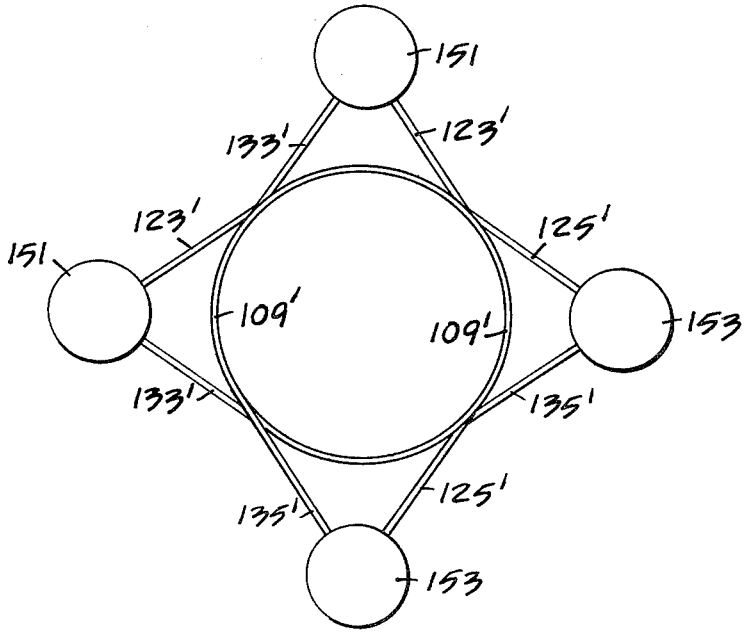
FIG. 7 is a schematic representation similar to FIG. 5 while illustrating an alternate embodiment of the invention.

In FIG. 7, an alternate embodiment of annular tubes is illustrated for interconnection between two pairs of inlet and outlet header conduits. The header conduits are arranged with approximately 90° spacing, each of the inlet header conduits 151 being arranged opposite one of the outlet header conduits 153. Helical tubes 109' are employed within the embodiment of FIG. 7 to similarly interconnect each opposed pair of inlet and outlet header conduits 151 and 153.

A number of advantages are achieved through the use of an annular heater exchanger assembly such as that employed for the reheater section 10 of the vapor generator described above. For example, the inlet and outlet header conduits and the tubes 109 are directly cooled by the secondary fluid, such as steam, which flows internally through them. The steam protects these elements from adverse effects of the substantially higher temperatures of the primary heating fluid exiting from the conduits 43. In particular, the steam protects the inlet and outlet headers because they have insulation on their outer surfaces. Since the headers are the main load carrying members for the tube bundle, it is extremely important that they be maintained at the lowest possible temperature. The tie-bars 117 carry relatively minimal loads. Although they are not directly cooled by the steam, they are indirectly cooled because of their close contact with the tubes 109. Thus, substantially all significant elements of the heat exchanger assembly forming the reheater section 10 tend to experience temperatures substantially lower than that of the primary heating fluid.

In addition, the helical tubes 109 inherently provide expansion loops serving to accommodate differential thermal expansion and contraction within the reheater section 10. Thus, the helical tubes 109 form a particularly compact tube bundle 111 which does not require additional expansion loops and which provides increased structural reliability with minimum complexity and weight. The self-supporting structure of the annular tube bundle 111 either alone or in combination with the inlet and outlet header conduits eliminates the need for complicated support elements and adapts the reheater section 10 for use in both high temperature conditions and high shock environments such as may be encountered in seismic zones.

Still further, the heat exchanger configuration for the reheater section 10 inherently provides a relatively large frontal area which reduces the primary heating fluid film coefficient and accordingly reduces the actual temperature for the metal tubes 109. Because of the large frontal area, the reheater section 10 has a relatively low flow resistance for the primary fluid.

Various modifications of the present invention in addition to those shown and described herein will be apparent to those skilled in the art from the foregoing description and accompanying drawings. Accordingly, the scope of the present invention is defined only by the following appended claims.

What is claimed is:

1. A structurally self-supporting heat exchanger tube bundle assembly of annular configuration, comprising
   - an elongated inlet header conduit forming an internal passage for communicating a heat exchanger fluid into the tube bundle assembly,
   - an elongated outlet header conduit arranged parallel with said inlet header conduit, said outlet header conduit forming an internal passage through which the heat exchanger fluid exits the tube bundle assembly,
   - a multiplicity of helically shaped heat exchanger tubes forming an annular tube bundle for the tube bundle assembly, said helical tubes each being formed about a common axis parallel with said inlet and outlet header conduits and including one full loop and one partial loop with its opposite ends being secured in fluid communication with said inlet and outlet header conduits respectively, at least some of said helical tubes being arranged with said partial loops in diametric opposition to the partial loops of other of said helical tubes, and
   - tie means for interconnecting adjacent portions of helical tubes in said annular tube bundle to provide increased structural strength and resistance to vibration.

2. The heat exchanger tube bundle assembly of claim 1 further comprising baffle means for producing uniform external fluid flow about said tubes.

3. The heat exchanger tube bundle assembly of claim 1 wherein, the inlet and outlet header conduits are radially arranged outside of the annular tube bundle.

4. The heat exchanger tube bundle assembly of claim 3 wherein the inlet and outlet header conduits are arranged generally in diametric opposition to each other, each of said helical tubes including one full loop and one-half loop for interconnection of its opposite ends with the diametrically opposed header conduits.

5. The heat exchanger tube bundle assembly of claim 4 wherein each helical tube includes at least one full loop and one-half loop.

6. The heat exchanger tube bundle assembly of claim 1 wherein each helical tube includes a plurality of full loops and one partial loop.

7. A structurally self-supporting heat exchanger assembly, comprising
   - elongated structural inlet and outlet header conduits each forming an internal passage along its length, the header conduits being arranged in parallel spaced-apart relation,
   - a multiplicity of helical heat exchanger tubes forming an annular tube bundle arranged between and parallel with said inlet and outlet header conduits, each tube including one full loop and one partial loop with its opposite ends structurally secured to said inlet and outlet header conduits respectively,
   - tie means interconnecting adjacent portions of said multiplicity of tubes within said annular tube bundle,
   - means for directing a first fluid externally past the tubes in said tube bundle, and
   - means for directing a second fluid into said multiplicity of tubes through said inlet header conduit and for receiving said second fluid from said outlet header conduit at least some of said helical tubes being arranged with their said partial loops in diametric opposition to the partial loops of other of said helical tubes.

8. The heat exchanger tube bundle assembly of claim 7 wherein said means for directing the first fluid comprises baffle means for producing uniform flow through said tube bundle.

9. The heat exchanger tube bundle assembly of claim 7 wherein, the inlet and outlet header conduits are radially arranged outside of the annular tube bundle.

10. The heat exchanger tube bundle assembly of claim 7 wherein the inlet and outlet header conduits are arranged in generally diametric opposition to each other, each of said helical tubes including one full loop and one-half loop for interconnection of its opposite ends with the diametrically opposed header conduits.

11. The heat exchanger assembly of claim 7 forming a portion of a vapor generator associated with a gas-cooled nuclear reactor.

12. A heat exchanger or vapor generator arranged in an elongated substantially cylindrical chamber, comprising
   - a main heat exchanger tube bundle assembly for internally circulating a secondary heat exchanger fluid,
   - a reheater section arranged in an axial portion of the chamber and including
     - structural inlet and outlet header conduits each forming an internal passage along its length, the header conduits being arranged in parallel spaced-apart relation,
     - a multiplicity of helical heat exchanger tubes forming an annular tube bundle arranged between and parallel with said header conduits, each tube including one full loop and one partial loop with its opposite ends secured to said inlet and outlet header conduits respectively, certain of the helical tubes being arranged in diametric opposition to the other helical tubes,
     - tie means interconnecting adjacent portions of said multiplicity of tubes within said annular tube bundle,
   - means for directing a primary heating fluid through the chamber past the reheater section and main heat exchanger tube bundle assembly, and
   - means for directing a fluid to be reheated into said reheater tube bundle through said inlet header conduit and for receiving reheater fluid from the reheater tube bundle through said outlet header conduit.

13. The heat exchanger or vapor generator of claim 12 wherein said main heat exchanger tube bundle assembly comprises a high temperature section having a plurality of parallel tubes forming an elongated tube bundle extending along a linear axis of the cylindrical chamber and a low temperature section having a plurality of substantially helical tubes forming an annular tube bundle positioned coaxially about a portion of said high temperature section, said low temperature section having an axial dimension substantially less than that of said high temperature section and being positioned adjacent one end thereof, said reheater section coaxially surrounding a portion of said high temperature section adjacent the other end of the cylindrical chamber.

* * * * *